United States Patent [19]

Muise

[11] Patent Number: 4,567,996

[45] Date of Patent: Feb. 4, 1986

[54] TWO-PIECE CONTAINER

[75] Inventor: Herbert D. Muise, Orange, Calif.

[73] Assignee: Weyerhaeuser Company, Tacoma, Wash.

[21] Appl. No.: 653,380

[22] Filed: Sep. 21, 1984

[51] Int. Cl.[4] ..... B65D 5/32; B65D 5/56; B65D 5/64; B65D 21/02

[52] U.S. Cl. ..... 220/416; 220/441; 229/32; 229/34 R; 229/34 HW; 229/43; 229/DIG. 11

[58] Field of Search ..... 220/416, 418, 441, 443; 229/DIG. 11, 34 R, 34 HW, 32, 23 R, 43

[56] References Cited

U.S. PATENT DOCUMENTS

| | | | |
|---|---|---|---|
| 2,357,009 | 8/1944 | Klein | 229/32 |
| 2,893,621 | 7/1959 | Harnish et al. | 229/34 R |
| 2,914,235 | 11/1959 | Jones | 229/34 R |
| 3,820,706 | 6/1974 | Gibson et al. | 229/34 R |
| 3,940,053 | 2/1976 | Putman et al. | 229/34 R |
| 4,101,048 | 7/1978 | Rieben et al. | 229/DIG. 11 |
| 4,103,819 | 8/1978 | Muise | 229/23 R X |
| 4,134,533 | 1/1979 | Heavner | 229/DIG. 11 |
| 4,187,977 | 2/1980 | Boykin et al. | 229/43 |

FOREIGN PATENT DOCUMENTS

| | | | |
|---|---|---|---|
| 639448 | 4/1962 | Canada | 229/DIG. 11 |
| 2248980 | 5/1975 | France | 229/DIG. 11 |
| 2449605 | 10/1980 | France | 229/DIG. 11 |
| 7271 | 1/1913 | United Kingdom | 229/34 R |
| 962191 | 7/1964 | United Kingdom | 229/DIG. 11 |

*Primary Examiner*—Allan N. Shoap

[57] ABSTRACT

A container having three-ply side walls and six-ply end walls. The container is formed from an inner and an outer container. The inner container has side and end walls and corner flaps. The outer container is adhered to the inner container and has outer side walls in contiguity with the outer faces of the inner container side walls and inner side walls in contiguity with the inner faces of the inner container side walls. The outer container has three exterior and two interior end panels. The three exterior end panels are attached to the side edges of the side panels and the end edges of the bottom panel. A first end panel extends across and is adhered to the end wall of the inner container. A second end panel extends across and is adhered to said first end panel and a third end panel extends upwardly from the bottom panel and is adhered to the second end panel. The interior end panels are hingedly attached to two of the exterior end panels. The fourth end panel extends into and is adhered to the inner face of said inner container end wall and the fifth end panel is adhered to the fourth end panel.

12 Claims, 13 Drawing Figures

Fig. 2
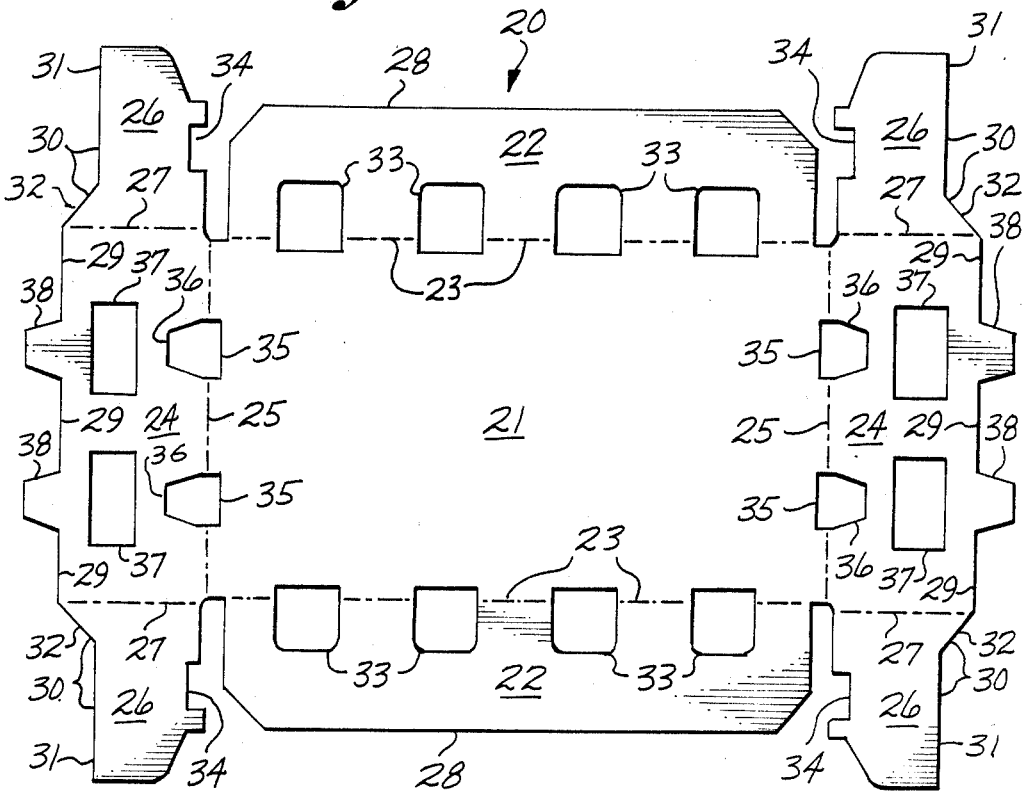
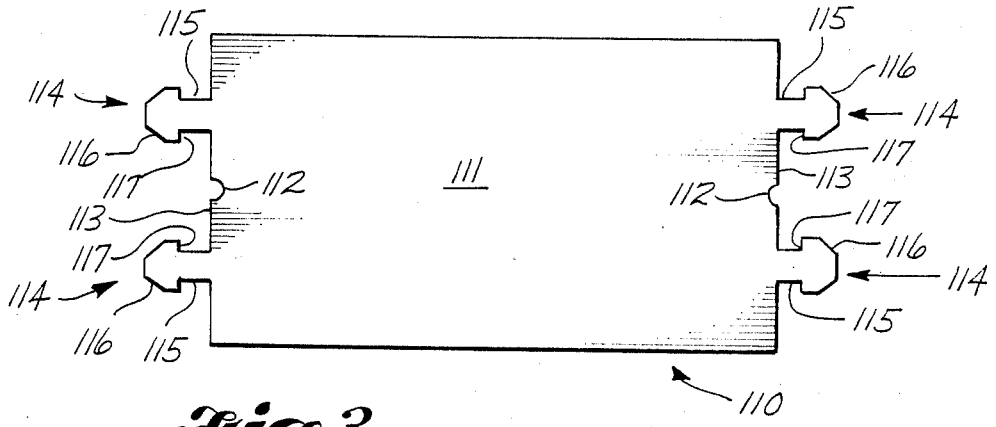
Fig. 3

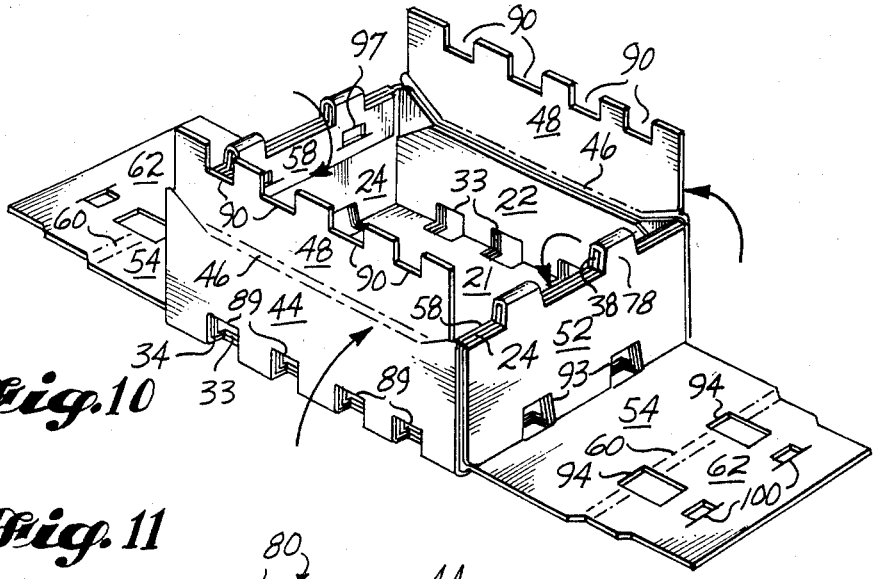
Fig. 10
Fig. 11
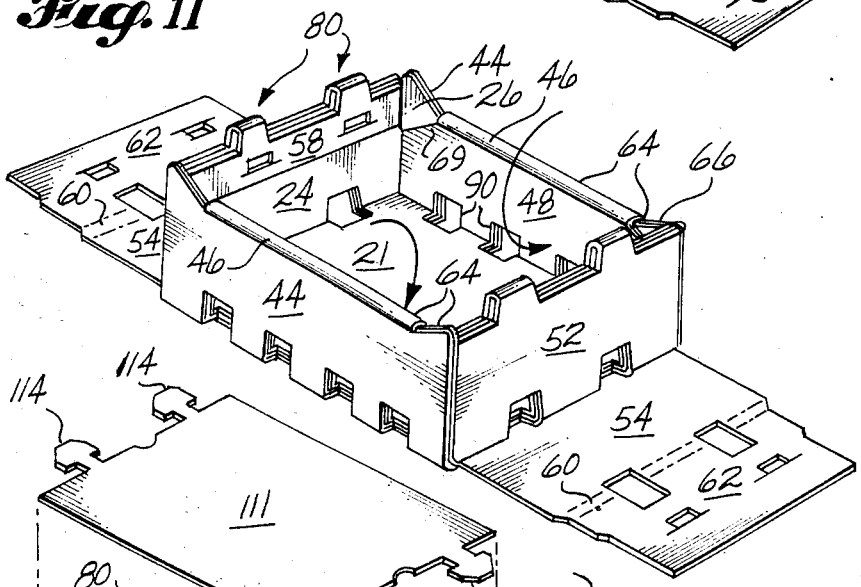
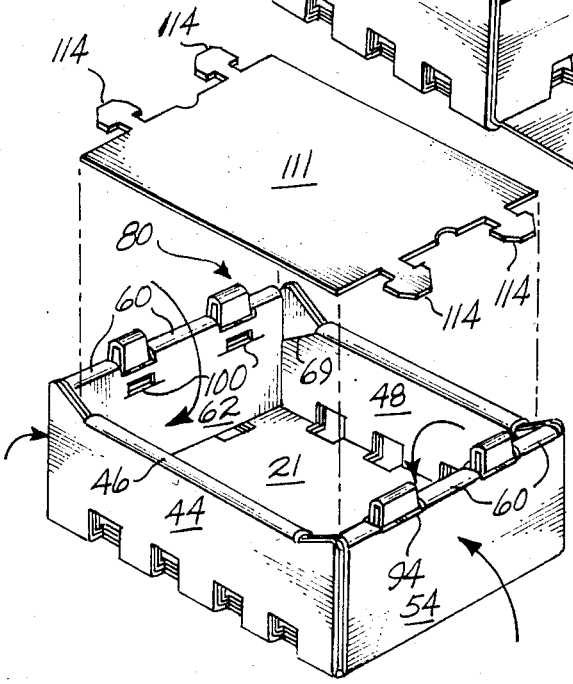
Fig. 12

TWO-PIECE CONTAINER

BACKGROUND OF THE INVENTION

Grapes are picked and placed in containers in the field. The containers are then stacked in the field and are later removed from the field to storage sheds. Temperatures in the fields can be in excess of 100° F. so the containers must both be insulated and ventilated so that the grapes do not dry out while standing in the field.

Wooden containers have traditionally been used because of the insulation provided by wood. Corrugated containers have been used from time to time.

There have been multi-layer corrugated containers. Three such containers are shown in Gibson, et al., U.S. Pat. No. 3,820,706 granted June 28, 1974; Putman, et al., U.S. Pat. No. 3,940,053 granted Feb. 28, 1976; and Muise, U.S. Pat. No. 4,103,819 granted Aug. 1, 1978.

SUMMARY OF THE INVENTION

The inventors wanted to make an insulated and ventilated container which would allow the packing and storage of grapes in the field. They realized it would require several layers of corrugated material to provide the necessary insulation. They devised a container having a three-layer side wall and a six-layer end wall. The containers are usually stacked in rows and it is the end walls through which the heat will normally pass.

It is difficult to provide this number of layers. The inventors decided that the best way of making a container which could be folded quickly and automatically was to provide a two-piece container having an inner container and an outer container. The walls of the outer container wrap around the walls of the inner container. This allowed a three-ply construction on each of the side and end walls. There were also panels attached to the side walls which folded over the end walls and created two more layers of insulation in the end walls. An additional end panel on one of these latter panels formed stacking tabs on the end walls.

BRIEF DESCRIPTION OF THE DRAWINGS

FIG. 2 is a top plan view of a blank for the inner container.

FIG. 3 is a top plan view of a blank for the container cover.

FIG. 10 is an isometric view showing the outer container outer side panels and their associated end panels in place and the third end panel folded over and being contiguous with the inner container end wall.

FIG. 11 is an isometric view showing the outer container inner side panels folded inwardly around the inner container side walls and end flaps.

FIG. 12 is an isometric view showing the outer container fourth and fifth end panels in place and the cover panel in exploded view.

DESCRIPTION OF THE PREFERRED EMBODIMENT

Figure 1:
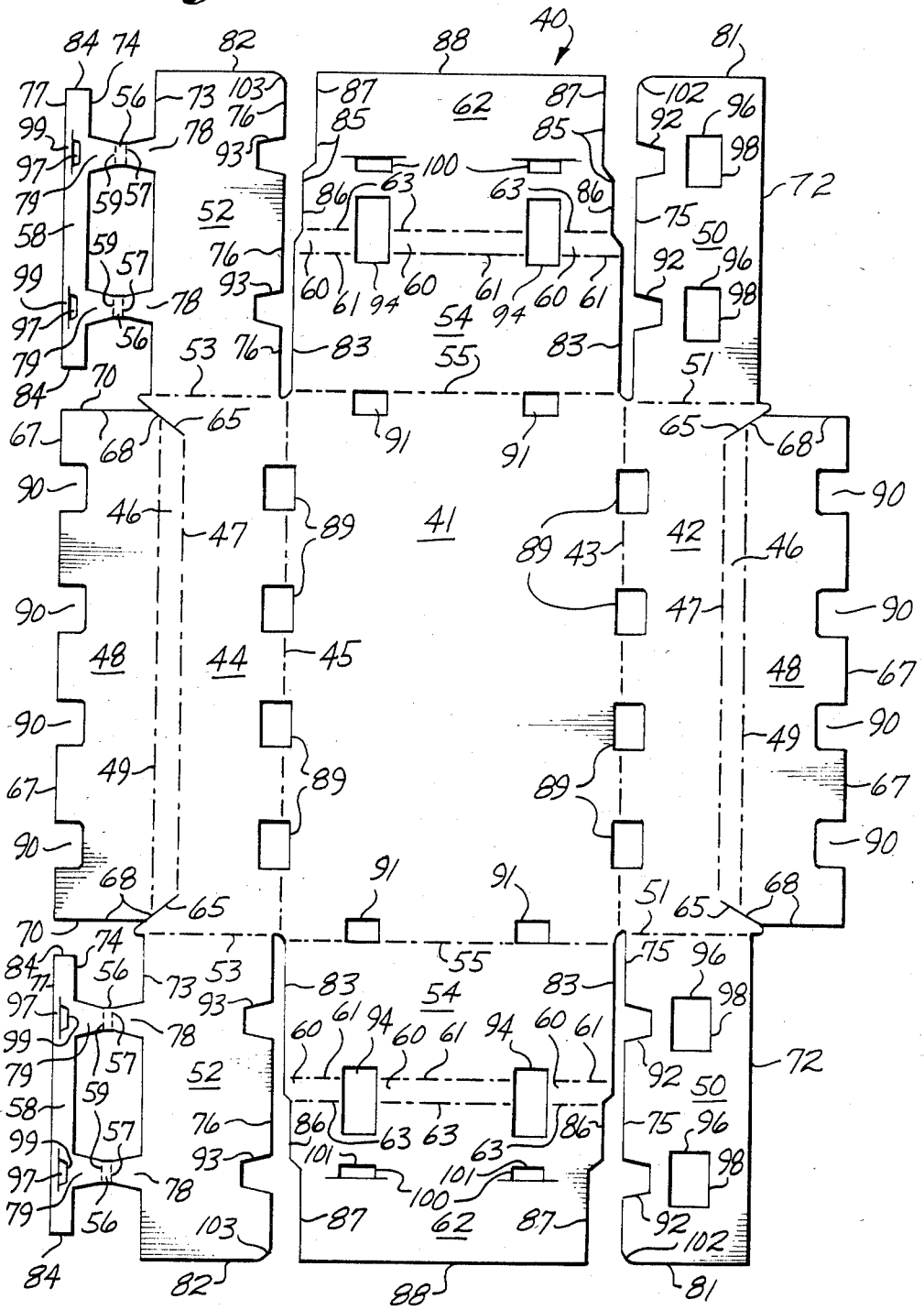
FIG. 1 is a top plan view of the blank for the outer container.

The container is formed from an inner container, and an outer container which wraps around the inner container.

The blank 20 of the inner container is shown in FIG. 2. The blank 20 has an inner container bottom wall 21. Inner container side walls 22 are attached to the inner container bottom wall 21 along score lines 23. The score lines 23 are parallel. Inner container end walls 24 are attached to the inner container bottom wall along score lines 25. The score lines 25 are parallel. The inner container bottom wall 21 is rectangular and score lines 23 are perpendicular to score lines 25. Inner container corner flaps 26 are attached to each side of the inner container end walls 24 along side score lines 27.

Figure 4:
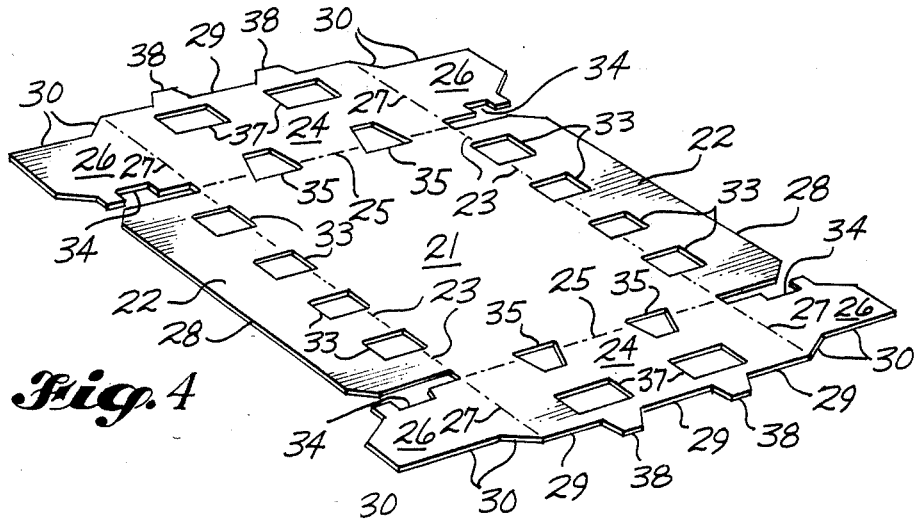
FIG. 4 is an isometric view of the inner blank.
Figure 5:
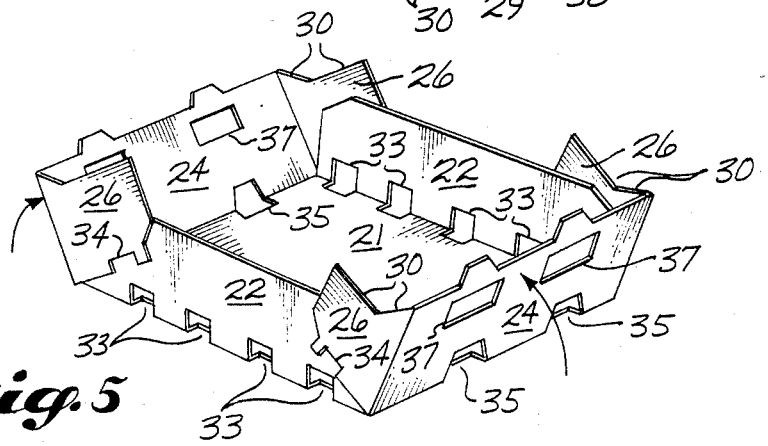
FIG. 5 is an isometric view of the inner container with the walls being folded into place.
Figure 6:
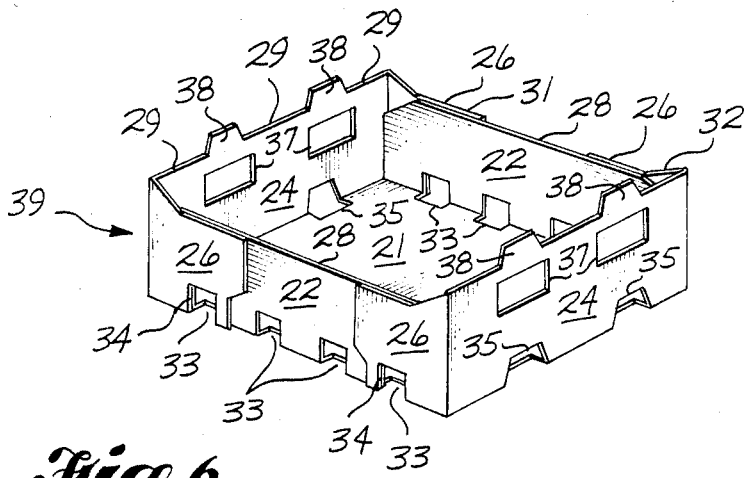
FIG. 6 is an isometric view of the formed inner container.
Figures 7, 8, 9:
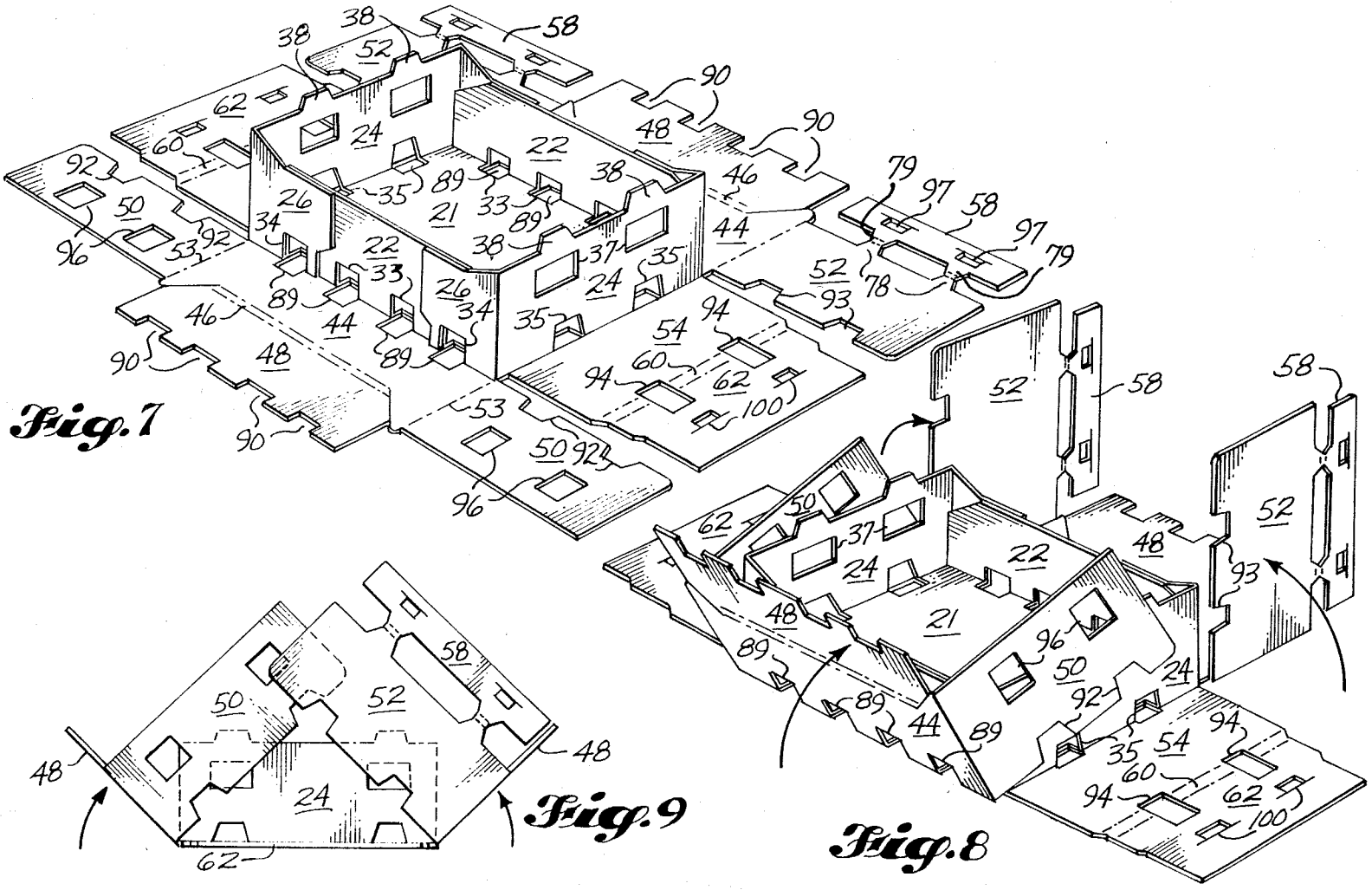
FIG. 7 is an isometric view showing the formed inner container on the blank of the outer container.
FIG. 8 is an isometric view of the containers with the outer side panels of the outer container and their attached end panels being folded around the inner container.
FIG. 9 is an end plan view similar to FIG. 8.

The container is formed by first forming the inner container 39. The process is shown in FIGS. 4–6. The inner container side walls 22 are bent upwardly around score lines 23 until the walls are perpendicular to the inner container bottom wall 21. The inner container end walls 24 are bent upwardly around score lines 25 until they are also perpendicular to the inner container bottom wall 21. The corner flaps 26 are bent inwardly around score lines 27 until they are contiguous with the outer face of the inner container side walls 22. These operations may be done separately or done in one operation, as shown in FIGS. 4–6, by passing the inner container bottom wall 21 through a set of forming shoes which fold inner container side walls 22, end walls 24 and corner flaps 26 into position.

The distance between the score lines 23 and the outer edges 28 of the inner container side walls 22 is less than the distance between the score lines 25 and the outer edges 29 of the inner container end walls 24 so that in the formed container the upper edges 29 of the inner container end walls 24 are higher than the upper edges 28 of the inner container side walls 22. The upper edges 30 of the corner flaps 26 are in two sections. The first flat section 31 of the upper edge 30 is parallel to the container bottom wall 21 in the formed container and at the same height as the upper edge 28 of the inner container side walls 22. The second oblique section 32 of the upper edge 30 of the corner flap extends between the first flat section 31 and the upper edge 29 of the inner container end walls 24. The second section 32 is a transition between the height of the upper edge 28 of the inner container side walls 22 and the upper edge 29 of the inner container end walls 24.

There are a number of apertures and reliefs in the inner container.

There are a number of vent holes 33 along the lower edge 23 of inner container side walls 22. There is a vent relief 34 in the lower edge of each of the corner flaps 26. The vent holes 33 and the vent relief 34 are of the same size and shape. Each of the vent reliefs 34 is aligned with an outer vent hole 33 in the formed inner container.

Stacking tab apertures 35 extend across the score lines 25 and are formed in the inner container bottom wall 21 and end walls 24. There is a stacking tab aperture for each of the stacking tabs in the container. Four stacking tab apertures are shown, two associated with each inner container end wall 24. The stacking tab aperture 35 extends into the inner container bottom wall 21 approximately one half the width of the stacking tab. The portion of the stacking tab aperture 35 formed in the inner container end wall 24 is trapezoidal in shape with its base along score line 25 being longer than its upper edge 36. The length and height of the stacking tab aperture 35 allows easy insertion of the stacking tabs and gives a close fit to the stacking tabs to allow good stacking of the containers.

There is a pair of cover lock apertures 37 in each inner end wall 24. These are rectangular in shape and are of a size and location to accommodate the end locks on the cover.

There is also a pair of inner container stacking tabs 38 on the upper edge of each of the inner container end walls 24.

The blank 40 for the outer container is shown in FIG. 1. The blank 40 has an outer container bottom panel 41. An outer container first side panel 42 is attached to bottom panel 41 along score line 43. An outer container second side panel 44 is attached to bottom panel 41 along score line 45. An outer container side ledge 46 is attached to each of the outer container side panels along score lines 47. Score lines 47 are parallel to score lines 43 and 45. An outer container third side panel 48 is attached to each of the ledges 46 along score lines 49.

There are a number of end panels attached to the bottom panel 41 and the first and second side panels 42 and 44. An outer container first end panel 50 is attached to each side of the outer container first side panel 42 along score lines 51. Outer container second end panels 52 are attached to the side edges of second side panels 44 along score lines 53. Outer container third end panels 54 are attached to bottom panel 41 along score lines 55. Outer container upper stacking tab sections 56 are attached to the second end panels 52 along score lines 57. Outer container fourth end panels 58 are attached to the upper stacking tab sections 56 along score lines 59. Outer container end ledges 60 are attached to the third end panels 54 along score lines 61. Outer container fifth end panels 62 are attached to the outer container end ledges 61 along score lines 63.

The outer container panels are dimensioned to allow the outer container to be wrapped around the inner container and the outer container panels to be adhered to the inner container walls.

The outer or upper edges 64 of the outer container first and second side panels 42 and 44 are formed by score lines 47 and oblique slits 65 and conform to the upper edges 28 and 30 of the inner container side walls 22 and corner flaps 26. The upper edges 64 have the intermediate flat section of score line 47 and the oblique end sections 66 formed by the oblique slits 65. The width of the outer container side ledge 46, the distance between score lines 47 and 49, allows the ledge 46 to fold over and across the flat sections 31 of the inner container corner flap 26 and the top of the inner container side wall 22. The height of the outer container third side panel 48, the distance between score line 49 and the outer edge 67 of the third side panel 48 allows the outer edge 67 of the third side panel 48 to rest against the inner container bottom wall 21 in the formed container.

The side edges 68 of the side ledges 46 and the third side panels 48 are in two sections. The slit 65 forming the oblique edge 66 on the first and second side panels 42 and 44 also forms a downwardly and outwardly extending oblique edge sections 69 on the side ledges 46. These oblique edge sections 69 allow the side ledges 46 to lock around the corner flaps 26 and the inner container side walls 22. The upper oblique edge sections 69 of the third side panels 48 also provide within the container a locking section for the fourth and fifth end panels 58 and 62. The section 70 of side edges 68 below the oblique upper edge section 69 are straight and parallel. The distance between the side edges 68 is equal to the distance between the inner container end walls 24 in the section 70. There is a snug fit of the third side panel 48 within the container in the section 70. There may be an upper relief section in section 70. The distance between the side edges 68 is less than the distance between the inner container end walls 24 in the relief section. The relief section of the side edges 68 may extend about half way down the third side panel 48.

Score lines 51, 53 and 55 are parallel but are not in alignment. Score line 53 is positioned one board width outwardly of score line 51 and score line 55 is positioned one board width outwardly of score line 53. The location of score line 51 allows the first end panel 50 to be bent inwardly and to be contiguous with the outer face of the inner container end wall 24. The location of score line 53 allows the second end panel 52 to be bent inwardly and be contiguous with the outer face of first end panel 50. The location of score line 55 allows the third end panel 54 to be bent upwardly and to be contiguous with the outer face of second end panel 52. The upper edges 72, 73 and 74 of the first, second and fourth end panels 50, 52 and 58, respectively, are of substantially the same height as the upper edge 29 of the inner container end walls 24. The height of the first and second end panels—the distance between their upper edges 72 and 73, respectively, and their lower edges 75 and 76, respectively—is substantially equal to the height of the container. The height of the fourth end panel 58 from its upper edge 74 to its lower edge 77 is substantially less than the height of the container. The lower edge 77 of the fourth end panel 58 will clear the upper oblique edge 69 of the third side panel 48 and allow the fourth end panel 58 to be contiguous with the inner face of the inner container end wall 24 and to provide support for the stacking tabs and aid the lid locking feature.

First and second outer stacking tab sections 78 and 79 extend upwardly from the upper edges 73 and 74 of the second and fourth end panels 52 and 58, respectively, and are joined to the upper stacking tab sections 56 along score lines 57 and 59, respectively. The first and second outer stacking tab sections 78 and 79 are aligned with the inner container stacking tabs 38 and the upper stacking tab sections 56 overlie the inner container stacking tabs 38. The inner container stacking tab 38 and the aligned first and second outer stacking tab sections 78 and 79 form the stacking tab 80.

The width of the first, second and third end panels 50, 52 and 54 provides support across the width of the container. The width of the first, second and third end panels 50, 52 and 54 is substantially equal to the width of the container. The distance between score line 51 and the side edge 81 of the first end panel 50 is substantially equal to the inner width of the outer container so that when the first end panel 50 is folded inwardly the side edge 81 will abut the inner face of second side panel 44. The distance between score line 53 and side edge 82 of the second end panel 52 is substantially equal to the distance between score line 51 and side edge 81 of the first end panel 50. The distance between the side edges 83 of the third end panel 54 is also substantially equal to the distance between score line 51 and side edge 81 of the first end panel 50.

The distance between the side edges 84 of the fourth end panel 58 is slightly less than the distance between the inner container side walls 22 to allow the fourth end panel 58 to be folded easily into the container.

The upper edges of the third and fifth end panels 54 and 62 defined by score lines 61 and 63 respectively are slightly higher than the upper edges of the other end panels to allow end ledge panel 60 to extend across the upper edges of the first, second and fourth end panels 50, 52 and 58 and the inner container end wall 24. The width of the end ledge 60 between the score lines 61 and 63 is equal to the combined thickness of the first, second and fourth end panels 50, 52 and 54 and the inner container end wall 24.

The side edges 85 of the fifth end panel 62 allow a snug fit of the fifth end panel within the container. The side edges 85 are in two sections, an inner or upper section 86 and an outer or lower section 87. The upper section 86 extends downwardly from the score line 63 to the upper edge 28 of the inner container side walls 22. The distance between the side edges 85 in the upper section 86 is equal to or slightly less than the inner distance between the corner flaps 26 of the inner container. The lower section 87 extends from the upper section 86 to the outer or lower edge 88 of the fifth end panel. The distance between the side edges 85 in the lower section 87 is equal to the inner distance between the third side panels 48 in the formed container.

The distance between score line 63 and the outer edge 88 of the fifth end panel allows the outer edge 88 to rest on the bottom wall 21 of the inner container 39.

There are also a number of apertures and reliefs in the outer container.

There are vent holes 89 along the lower edges 43 and 45 of the first and second side panels 42 and 44. The vent holes 89 extend a slight distance into the bottom panel 41. There are also vent reliefs 90 in the outer edge 67 of the third side panels 48. The vent holes 89 and reliefs 90 are of the same size and shape as the vent holes 33 in the side walls of the inner container and are aligned with the vent holes 33 in the formed container.

There are stacking tab apertures 91 in the bottom panel 41. The apertures 91 are adjacent score lines 55 along the end edges of the bottom panel 41. The apertures 91 are aligned with the stacking tab apertures 35 in the bottom and end walls 21 and 24 of the inner container. Stacking tab reliefs 92 and 93 extend inwardly from the lower edges 75 and 76 of the first and second end panels 50 and 52, respectively. These are of the same trapezoidal shape and of the same size as the stacking tab apertures 35 in the inner container end walls 24, and are aligned with the stacking tab apertures 35 and with each other in the formed container.

There are also stacking tab apertures 94 in the end ledge 60. These apertures extend into the upper edge of the fifth end panels 62. The apertures 94 extend across the width of the end ledge 60 and allow the stacking tabs 80 to extend through the ledges 60 and above the upper edge of the end walls defined by the ledges 60. The distance between the edge of the aperture 94 defined the score line 61 and the edge 95 of the aperture 94 is slightly greater than the height of the stacking tab 80 to allow the fifth panel 62 to be bent over the stacking tabs 80 and into the interior of the container.

There are cover locking apertures in the first, fourth and fifth end panels 50, 58 and 62. The cover locking apertures 96 in the first end panel 50 are rectangular and of the same size and shape as the cover locking apertures 37 in the inner container end walls 24. The apertures 96 are aligned with the apertures 37 in the formed container. The cover locking apertures 97 in the fourth end panel are of the same width as cover locking apertures 96 but are of a much smaller height. The apertures 97 are aligned with the upper section of apertures 96. The upper edge 98 of aperture 96 is aligned with upper edge 99 of aperture 97. There is, however, a great difference in the height of the two apertures. For example, if the distance between the upper and lower edges of aperture 96 were approximately two inches then the distance between the upper and lowers of aperture 97 would be approximately five eighths of an inch. The cover locking apertures 100 in the fifth end panels 62 also have the same width as the cover locking apertures 96 and 97, and the upper edge 101 of the cover locking aperture 100 is aligned with upper edges 98 and 99. The height of aperture 100 is less than the height of aperture 97. Again if aperture 97 has a height of five eighths of an inch, aperture 100 would have a height of one fourth of an inch.

The first and second end panels also have corner reliefs in the outer lower corner, relief 102 being in the outer lower corner of the first end panel 50 and relief 103 being in the outer lower corner of the second end panel 52.

In forming the container, strips of adhesive are applied to the inner face of the outer container end panels. The formed inner container is then placed on the bottom panel 41 of the outer container. The outer container first and second end panels 50 and 52 are bent inwardly around score lines 51 and 53. The first and second side panels 42 and 44 are bent upwardly around their respective score lines 43 and 45. The first end panels 50 are adhered to the outer faces of the inner container end walls 24, and the second end panels 52 are adhered to the outer faces of the first end panels 50. The side ledges 46 are bent over the inner container side walls 22 and side flaps 26 and the third side panels 48 bent inwardly into the container and held by friction. The fourth end panels 58 are bent inwardly and adhered to the inner faces of the inner container end walls 24. The third end panels 54 are bent upwardly and adhered to the outer faces of the second end panels 52. The end ledges 60 are bent over the other end panels and walls, and the fifth end panels 66 are bent inwardly and adhered to the face of the fourth end panel 58 and the remainder of the inner face of the inner container end wall 24. The three laminations forming the stacking tab 80 are also adhered together.

If desired, the bottom panel 41 and side panels 44 and 48 of the outer container may be adhered to the bottom wall 21 and the side walls 22 and corner flaps 26 of the inner container.

Figure 13:
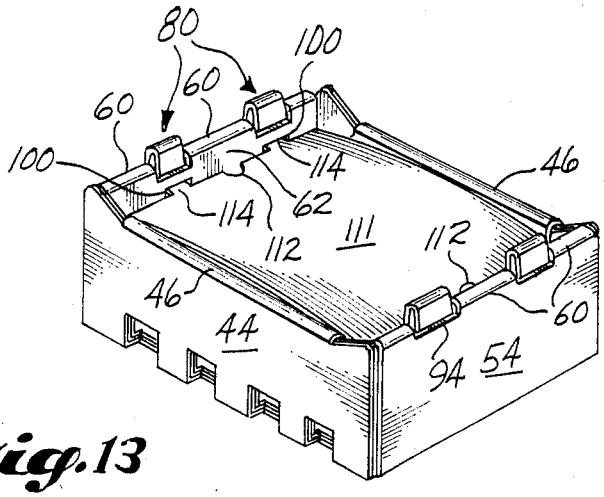
FIG. 13 is an isometric view of the covered container.

The blank 110 for the cover is shown in FIG. 3. The cover has a main cover panel 111. Finger holes 112 are located centrally of the end edges 113 of panel 111. Locking elements 114 also extend from end edges 113. The locking elements 114 have necks 115 and arrow shaped heads 116. There are locking ledges 117 between the heads 116 and the necks 115. The cover panel 111 is slightly longer than the inner length of the container and bows upwardly when it is placed in position. The locking elements 114 extend through the cover locking apertures 100 and into the interior apertures 97, 96 and 37. The element passes through the outer locking apertures 100 and 97 and extends downwardly into the apertures 96 and 37. The smaller sized outer apertures prevent easy withdrawal of the locking elements 114. The cover is bowed outwardly as shown in FIG. 13.

I claim:

1. A two-piece container comprising
an inner container and
an outer container;
said inner container comprising
a bottom wall,
side walls extending upwardly from the side edges of said bottom wall,
end walls extending upwardly from the end edges of said bottom wall,
corner flaps extending outwardly from the side edges of said end walls and overlapping and being contiguous with said side walls;
said outer container comprising
a bottom panel contiguous with said inner container bottom wall,
a first side panel extending upwardly from said bottom panel and being contiguous with the outer face of one of said inner container side walls and its associated corner flaps,
a second side panel extending upwardly from the opposing side edge of said bottom panel and being contiguous with the outer face of the other of said inner container side walls and its associated corner flaps,
side ledges extending inwardly from the upper edge of each of said first and second side panels, said side ledges extending over the upper edge of said inner container side walls and associated corner flaps,
third side panels extending downwardly from said side ledges and being contiguous with the inner faces of said inner container side walls,
first end panels extending from the side edges of said first side panel, each being of approximately the same size and being contiguous with the outer face of one of said inner container end walls,
second end panels extending outwardly from the side edges of said second side panels, each being of approximately the same size and being contiguous with the outer face of one of said first end panels,
third end panels extending upwardly from the end edges of said bottom panel, each being of approximately the same size and being contiguous with the outer face of one of said second end panels,
fourth end panels attached to said second end panels, each extending downwardly into said container and being contiguous with the inner face of one of said inner container end walls,
end ledges attached to the upper edges of said third end panels, said end ledges extending across said second, first and fourth end panels and said inner container end wall,
fifth end panels attached to said end ledges and extending downwardly into said container, each being contiguous with the inner face of one of said fourth end panels.

2. The container of claim 1 in which there are aligned vent holes in the lower edges of said inner container side walls and corner flaps, and said first, second and third side panels.

3. The container of claim 1 in which
the upper edges of said inner container end wall and said first, second, third, fourth and fifth end panels are of substantially the same height, and
stacking tabs extend upwardly from the upper edges of said inner container end walls,
aligned stacking tab elements extend upwardly from said second and fourth end panels, said stacking tab elements being aligned with said inner container stacking tabs and being attached at their outer ends, and
stacking tab apertures are formed in said bottom wall and bottom panel and the lower portions of said end walls and certain of said end panels.

4. The container of claim 3 in which
stacking tab apertures are formed in said end ledges, and
said stacking tabs extend upwardly through said end ledge stacking tab apertures.

5. The container of claim 1 further comprising
locking apertures in certain of said end panels and end walls.

6. The container of claim 5 further comprising
a cover,
locking elements on the ends of said cover,
said locking elements extending through said locking apertures.

7. The container of claim 1 further comprising
a first aperture in said fifth end panel,
a second aperture in said fourth end panel,
a third aperture in said inner container end wall,
a fourth aperture in said first end panel,
said first, second, third and fourth apertures having aligned upper edges,
said third and fourth apertures being of the same size and shape and being aligned,
said second aperture having a lower edge that is between the upper and lower edges of said third and fourth aperture, and
said first aperture having a lower edge that is between the upper and lower edges of said second aperture.

8. The container of claim 7 further comprising
a cover,
locking elements on the ends of said cover,
said locking elements extending through said first, second, third and fourth apertures.

9. A blank for a container comprising
a bottom panel,
a first side panel attached to a first side edge of said bottom panel,
a second side panel attached to a second side edge of said bottom panel,
third side panels attached to the outer edges of said first and second side panels,
first end panels each having a first side edge attached to the side edge of said first side panel and a second side edge spaced from said first side edge, the distance between said first end panel first and second side edges being substantially equal to the distance between said bottom panel first and second side edges,
second end panels each having a first side edge attached to the side edge of said second side panels and a second side edge spaced from said first side edge, the distance between said second end panel first and second side edges being substantially equal to the distance between said bottom panel first and second side edges, third end panels attached to the end edges of said bottom panel, fourth end panels attached to the outer edges of said second end panels, and fifth end panels attached to the outer edges of said third end panels.

10. The blank of claim 9 in which aligned stacking tab elements extend upwardly from said second and fourth end panels, said stacking tab elements being attached at their outer edges, stacking tab apertures are formed in said bottom panel and the lower portions of certain of said end panels, an end ledge is between said third and fifth panels, stacking tab apertures are formed in said end ledges, and said stacking tab elements, said stacking tab apertures, and said end ledge stacking tab apertures are aligned in the erect container.

11. The blank of claim 9 further comprising a first aperture in said fifth end panel, a second aperture in said fourth end panel, a third aperture in said first end panel, said first, second and third apertures having aligned upper edges in the erect container, said second aperture having a lower edge that is between the upper and lower edges of said third aperture in the erect container, and said first aperture having a lower edge that is between the upper and lower edges of said second aperture in the erect container.

12. A two-piece container comprising an inner container and an outer container;

said inner container comprising a bottom wall, side walls extending upwardly from the side edges of said bottom wall, end walls extending upwardly from the end edges of said bottom wall, said outer container comprising a bottom panel in contiguity with said inner container bottom wall, a first side panel extending upwardly from said bottom panel and in contiguity with the outer face of one of said inner container side walls, a second side panel extending upwardly from the opposing side edge of said bottom panel and in contiguity with the outer face of the other of said inner container side walls, side ledges extending inwardly from the upper edge of each of said first and second side panels, said side ledges extending over the upper edge of said inner container side walls and associated corner flaps, third side panels extending downwardly from said side ledges and in contiguity with the inner faces of said inner container side walls, first end panels extending from the side edges of said first side panel, each being of approximately the same size and in contiguity with the outer face of one of the inner container end walls, second end panels extending outwardly from the side edges of said second side panels, each being of approximately the same size and in contiguity with the outer face of one of said first end panels, third end panels extending upwardly from the end edges of said bottom panel, each being of approximately the same size and in contiguity with the outer face of one of said second end panels, fourth end panels attached to said second end panels, each extending downwardly into said container and being in contiguity with the inner face of one of said inner container end walls, end ledges attached to the upper edges of said third end panels, said end ledges extending across said second, first and fourth end panels and said inner container end wall, fifth end panels attached to said end ledges and extending downwardly into said container, each being in contiguity with the inner face of one of said fourth end panels.

* * * * *